US009080111B1

(12) United States Patent
Huff et al.

(10) Patent No.: US 9,080,111 B1
(45) Date of Patent: Jul. 14, 2015

(54) SYSTEM AND METHOD FOR ADDING BLEND STOCKS TO GASOLINE OR OTHER FUEL STOCKS

(75) Inventors: Nicholas Huff, Sand Springs, OK (US); Hele Bon Thompson, Tulsa, OK (US)

(73) Assignee: Magellan Midstream Partners, L.P., Tulsa, OK (US)

( * ) Notice: Subject to any disclaimer, the term of this patent is extended or adjusted under 35 U.S.C. 154(b) by 890 days.

(21) Appl. No.: 13/283,081

(22) Filed: Oct. 27, 2011

Related U.S. Application Data

(66) Substitute for application No. 61/410,534, filed on Nov. 5, 2010.

(51) Int. Cl.
*C10G 29/20* (2006.01)

(52) U.S. Cl.
CPC ..... *C10G 29/205* (2013.01)

(58) Field of Classification Search
CPC ..... C10G 29/205
USPC ..... 366/152.1, 348, 349
See application file for complete search history.

(56) References Cited

U.S. PATENT DOCUMENTS

| | | | | |
|---|---|---|---|---|
| 2,361,478 | A | 10/1944 | Jennings | |
| 2,859,757 | A | 11/1958 | Parsons | |
| 3,209,771 | A | 10/1965 | Gogarty et al. | |
| 3,219,046 | A | 11/1965 | Waugh | |
| 3,316,168 | A | 4/1967 | Mernitz | |
| 3,385,680 | A | 5/1968 | Feld et al. | |
| 3,426,776 | A | 2/1969 | Nicholas | |
| 3,437,461 | A | 4/1969 | Hoffman et al. | |
| 3,451,402 | A | 6/1969 | Howard | |
| 3,477,461 | A | 11/1969 | Clayton et al. | |
| 3,484,590 | A | 12/1969 | Stanton | |
| 3,530,867 | A | 9/1970 | Haas | |
| 3,751,644 | A | 8/1973 | Mayer | |
| 3,999,959 | A | 12/1976 | Bajek | |
| 4,876,653 | A | 10/1989 | McSpadden et al. | |
| 5,125,533 | A | 6/1992 | Gayner et al. | |
| 5,223,714 | A | 6/1993 | Maggard | |
| 5,288,393 | A | 2/1994 | Jessup et al. | |
| 5,430,295 | A * | 7/1995 | Le Febre et al. | 250/340 |
| 5,485,148 | A | 1/1996 | Tseng | |
| 5,569,922 | A | 10/1996 | Clarke | |

(Continued)

OTHER PUBLICATIONS

Grabner Instruments MINIVAP VPS/H Vapor Pressure Tester Specifications, with Release Date (1998) , Retrieved Sep. 2014, Ametek Inc.*

(Continued)

*Primary Examiner* — Tony G Soohoo
*Assistant Examiner* — Abbas Rashid
(74) *Attorney, Agent, or Firm* — Dennis D. Brown; Brown Patent Law, PLLC

(57) ABSTRACT

A method, system, and apparatus for addition of a blending stock to a fuel stock flowing through a line in order to blend up the fuel stock, and/or to blend up a heel material contained in a tank to which the blended product is to be delivered. The actual volatility of the blended product flowing through the line is monitored using an automated volatility analyzer. The blending stock is added to the fuel stock in the line at a blending rate which is automatically controlled by comparing the measured actual volatility value to either a target volatility value for the blended product or a modified target volatility value which can be implemented for the purpose of also blending up a tank heel.

26 Claims, 4 Drawing Sheets

(56) References Cited

U.S. PATENT DOCUMENTS

| | | | |
|---|---|---|---|
| 5,593,463 | A | 1/1997 | Gambini et al. |
| 5,593,567 | A | 1/1997 | Jessup |
| 5,599,357 | A | 2/1997 | Leeper |
| 5,653,866 | A | 8/1997 | Jessup et al. |
| 5,755,389 | A | 5/1998 | Miyasaki |
| 5,837,126 | A | 11/1998 | Jessup et al. |
| 5,979,705 | A | 11/1999 | Kaehler et al. |
| 5,981,283 | A | 11/1999 | Anderson, II et al. |
| 6,006,775 | A | 12/1999 | Negley, III |
| 6,030,521 | A | 2/2000 | Jessup et al. |
| 6,159,255 | A | 12/2000 | Perkins |
| 6,161,060 | A | 12/2000 | Collins |
| 6,163,738 | A | 12/2000 | Miller |
| 6,253,779 | B1 | 7/2001 | Nanaji et al. |
| 6,290,734 | B1 | 9/2001 | Scott et al. |
| 6,328,772 | B1 | 12/2001 | Scott et al. |
| 6,370,515 | B1 | 4/2002 | Diamond et al. |
| 6,390,114 | B1 | 5/2002 | Haandrikman et al. |
| 6,419,716 | B2 | 7/2002 | Scott et al. |
| 6,540,797 | B1 | 4/2003 | Scott et al. |
| 6,582,591 | B1 | 6/2003 | Jaubert et al. |
| 6,679,302 | B1 | 1/2004 | Mattingly et al. |
| 6,712,866 | B2 | 3/2004 | Paul |
| 6,716,268 | B2 | 4/2004 | Molyneux et al. |
| 6,912,472 | B2 | 6/2005 | Mizushina et al. |
| 6,966,326 | B2 | 11/2005 | Murray et al. |
| 6,978,210 | B1 | 12/2005 | Suter et al. |
| 7,032,629 | B1 | 4/2006 | Mattingly et al. |
| 7,035,767 | B2 | 4/2006 | Archer et al. |
| 7,068,170 | B2 | 6/2006 | Green |
| 7,100,627 | B2 | 9/2006 | Hollander |
| 7,228,250 | B2 | 6/2007 | Naiman et al. |
| 7,302,301 | B2 | 11/2007 | Becker |
| 7,456,328 | B2 | 11/2008 | Bary |
| 7,540,887 | B1 | 6/2009 | Turocy |
| 7,587,481 | B1 | 9/2009 | Osburn, III |
| 7,631,671 | B2 | 12/2009 | Mattingly et al. |
| 7,720,575 | B2 | 5/2010 | Ferber et al. |
| 7,741,525 | B2 | 6/2010 | Bary |
| 2001/0001131 | A1 | 5/2001 | Miller |
| 2003/0040650 | A1 | 2/2003 | Butler et al. |
| 2003/0183554 | A1 | 10/2003 | Bazzani et al. |
| 2004/0057334 | A1 | 3/2004 | Wilmer et al. |
| 2004/0127371 | A1 | 7/2004 | Arrowsmith et al. |
| 2004/0144688 | A1 | 7/2004 | Hong-Lin |
| 2005/0058016 | A1 | 3/2005 | Smith et al. |
| 2005/0143609 | A1 | 6/2005 | Wolf et al. |
| 2005/0177013 | A1 | 8/2005 | Countz |
| 2005/0234273 | A1 | 10/2005 | Chen |
| 2005/0256352 | A1 | 11/2005 | Clark et al. |
| 2006/0037237 | A1 | 2/2006 | Copeland et al. |
| 2006/0058564 | A1 | 3/2006 | Sills et al. |
| 2006/0070912 | A1 | 4/2006 | Khan |
| 2006/0162243 | A1 | 7/2006 | Wolf |
| 2006/0278304 | A1 | 12/2006 | Mattingly et al. |
| 2007/0033859 | A1 | 2/2007 | Ketley et al. |
| 2010/0084047 | A1 | 4/2010 | Mattingly et al. |
| 2010/0175313 | A1 | 7/2010 | Mattingly et al. |

OTHER PUBLICATIONS

Avella, Michael, et al., "Pipeline Model Loading: An Integrated and Automated Approach", Oct. 22, 2004, Publisher: Pipeline Simulation Interest Group, Published in: US.

Grabner Measurement Systems, "About Vapor Pressure Testing", Jan. 26, 2001, Publisher: Internet, Published in: US.

Townsend, et al., "H1305 Reformulated Gasolines and Methods of Producing Reformulated Gasolines", May 3, 1994, Publisher: USPTO, Published in: US.

Brundage, et al., "H2124 Blending of Economic, Reduced Oxygen, Summer Gasoline", Oct. 4, 2005, Publisher: USPTO, Published in: US.

Brundage, et al., "H2125 Blending of Economic, Ether Free Summer Gasoline", Oct. 4, 2005, Publisher: USPTO, Published in: US.

Brundage, et al., "H2135 Blending of Economic, Reduced Oxygen, Summer Gasoline", Dec. 6, 2005, Publisher: USPTO, Published in: US.

Brundage, et al., "H2150 Blending of Economic, Ether Free Summer Gasoline", Apr. 4, 2006, Publisher: USPTO, Published in: US.

Brundage, et al., "H2170 Blending of Economic, Reduced Oxygen, Summer Gasoline", Sep. 5, 2006, Publisher: USPTO, Published in: US.

Brundage, et al., "H2210 Blending of Economic Reduced Oxygen Summer Gasoline", Feb. 5, 2008, Publisher: USPTO, Published in: US.

Brundage, et al., "H2248 Blending of Economic, Reduced Oxygen, Winter Gasoline", Sep. 7, 2010, Publisher: USPTO, Published in: US.

Brundage, et al., "H2249 Blending of Economic, Reduced Oxygen, Winter Gasoline", Sep. 7, 2010, Publisher: USPTO, Published in: US.

Hull, Bradley, Ph.D., "Oil Pipeline Markets and Operations", Dec. 15, 2004, Publisher: Department of Management, Marketing and Logistics, John Carroll University, Published in: US.

Hull, Donald, et al., "Radioactive Tracers to Mark Interfaces and Measure Intermixing in Pipelines", Nov. 1952, pp. 2745-2750, vol. 44, No. 11, Publisher: Ind. Eng. Chem., Published in: US.

Ince, Brian T., "In-Line Blending (Control Systems)", Jan. 27, 2011, Publisher: JISKOOT, Published in: US.

Rittie, Kevin J., "Interfacing Pipeline Simulators to Realtime Control Systems", Oct. 22, 2004, Publisher: Pipeline Simulation Interest Group, Published in: US.

Singh, A., et al., "Model-Based Real-Time Optimization of Automotive Gasoline Blending Operations", 2000, Publisher: Elseriver: Journal of Process Control, 10, 43-58.

Kelly, J. D., et al., "Crude Oil Blend Scheduling Optimization: An Application With Multimillion Dollar Benefits", Reprinted from: Hydrocarbon Processing, Jun. 2003, pp. 47-53 and Jul. 2003, pp. 72-79.

* cited by examiner

SYSTEM AND METHOD FOR ADDING BLEND STOCKS TO GASOLINE OR OTHER FUEL STOCKS

This application claims the benefit of U.S. Provisional Patent Application Ser. No. 61/410,534, filed on Nov. 5, 2010, the disclosure of which is incorporated herein by reference as if fully set out at this point.

FIELD OF THE INVENTION

The present invention relates to in-line processes and systems for blending butane and/or other blend stocks with gasoline and/or other fuel stocks. By way of example, but not by way of limitation, some preferred blend stocks include butane, natural gasoline, alkylate, iso-butane, naphtha, raffinate, gasoline blend stock materials, and gasoline. By way of example, but not by way of limitation, some preferred fuel stocks include gasoline, reformulated blend stock (RBOB), conventional blend stock (CBOB), gasoline blend stock materials, ethanol, diesel, and jet fuel.

BACKGROUND OF THE INVENTION

Gasoline products delivered to service stations for purchase by consumers are typically formed by blending together a number of different gasoline blending stock products. These blending stock products typically comprise liquid products produced by various processing units in a petroleum refinery. The selection and blending of the blending stock products must be performed so that the resulting gasoline blend (a) meets the necessary octane rating (R+M/2) for the blend and (b) has an acceptable Reid Vapor Pressure (RVP).

The maximum allowable RVP for a gasoline blend varies throughout the year and can also vary geographically. Generally, the maximum allowable RVP for a gasoline blend is much higher during cold weather months than in warm weather conditions. For summer blends, there are federal, state, and/or municipal regulations in place which limit the maximum allowable RVP of the blend in order to reduce gasoline vapor emissions, reduce ozone production levels, and/or alleviate smog conditions. These regulatory restrictions typically extend from about the first of May to the middle of September and commonly require that the RVP of the blend not exceed a maximum value somewhere in the range of from about 6.6 psi to about 9.0 psi.

One component commonly used in forming gasoline blends is butane. Butane has a desirably high octane rating (R+M/2) which averages about 92-93 but also has a high average RVP of about 52 psi. Consequently, butane blending is typically reduced significantly during warm weather months in order to comply with the regulatory restrictions on allowable gasoline RVP.

Moreover, during any time of year, and particularly during cold weather months, the amount of butane or other volatile components contained in a gasoline blend will commonly be lower than is necessary such that the actual RVP of the blend will be well below the maximum RVP limit. The difference between the maximum RVP target of the gasoline blend and the actual vapor pressure of the blend is referred to as the "available RVP margin." By way of example, the actual RVP of a given gasoline blend might be significantly below the maximum RVP limit because (a) the amount of butane or other volatile components initially included in the blend by the blending operator was set at an unnecessarily low level in order to provide an excessive margin of safety, (b) the blend is delivered to an area having a higher allowable RVP (c) the blend is delivered during a seasonal transition period, and/or (d) the upstream blending system was unable to provide an adequate degree of precision and control to achieve the RVP target.

Different techniques have been used heretofore for adding supplemental butane to gasoline blends having significant available RVP margins. The addition of butane to a gasoline blend having a significant available RVP margin is beneficial to both suppliers and consumers. For suppliers, the addition of butane to a gasoline blend allows the supplier to increase the price margin on the butane by selling the product as gasoline. For the consumer, butane blending is beneficial, particularly during cold weather months, because it increases the overall gasoline supply, reduces the cost of gasoline, and provides better cold weather ignition.

The systems used heretofore for the in-line blending of butane with gasoline streams in pipelines and elsewhere have had significant shortcomings. One type of system previously suggested for in-line butane blending is a feed-forward control system of the type described in U.S. Pat. No. 7,631,671. In the feed-forward blending system, the vapor pressure of the incoming gasoline stream is periodically determined, and the vapor pressure of the incoming butane stream is also periodically determined or a theoretical value for the butane is assigned, and these values are used to predictively calculate and implement a blend ratio based upon an allowable vapor pressure for the blend.

Unfortunately, feed-forward systems of this type have significant shortcomings and disadvantages which adversely affect the operation, performance, and efficiency of the blending system. By way of example, some of the problems and shortcomings experienced with the feed-forward systems include:

1. A high potential for error caused by the need to integrate and rely upon multiple meter and analyzer inputs;
2. The cost of purchasing, installing and maintaining all of the metering systems and analyzers;
3. Difficulty in troubleshooting due to all of the multiple inputs and potential sources of problems and error;
4. A further lack of accuracy, precision, and certainty due to the fact that the individual variabilities of the various inputs can be additive;
5. The necessity of assuming that all of the individual variabilities are additive, thus requiring that a much wider margin of error be accounted for when setting the target RVP (control limit) for blending versus the actual allowable maximum RVP specification for the gasoline, which in turn leads to significant under-blending of butane.
6. A lack of accuracy sufficient to allow truly effective use of the feed-forward system for simultaneously blending-up tank heels; and
7. An inability to adapt to conditions and fluctuations commonly experienced when other components such as W grade natural gasoline or transmix are also concurrently added without online analysis to the gasoline, thus resulting in a significant potential for over-blending or under-blending.

Also, feed-forward systems require significant oversight of the butane supply to ensure that tight specifications for allowable butane pressure are met. Because a forwardly imposed (calculated) RVP of the downstream blend, rather than an actual measured RVP of the blend, is used to determine the butane injection rate, the minimum variability of the feed-forward system typically will not be less than the variability of the RVP of the butane supply, which may be in the range of ±20%.

Other types of in-line butane blending systems used heretofore have employed feed-back controls wherein RVP determinations for the finished gasoline blend product have been used to calculate the butane blending ratio. Unfortunately, these prior feed-back systems have had significant shortcomings and disadvantages which adversely affect the operation, performance, and efficiency of the blending system. For example, these systems have lacked both the capability and the know-how necessary for consistently hitting and maintaining the target RVP (control limit) for the blend and for adapting to swings in butane RVP or to changes in other feed properties or rates. This, in turn, has resulted in significant under-blending because of the large margin of safety which must be maintained between the target RVP and the maximum allowable RVP specification for the gasoline in order to account for the lack of precision and control. In addition, these same deficiencies have (a) prevented the prior systems from being used for blending-up tank heels or blending concurrently with the injection of W grade natural gasoline, transmix, or other additives, and/or (b) resulted in significant under-blending when attempting to perform such operations in order to maintain an adequate margin of safety.

As is thus apparent, a need exists for an improved in-line butane blending system which will (a) provide greater blending accuracy and efficiency, (b) further reduce missed RVP margins to maximize butane blending, (c) adapt more quickly to pipeline flows, batch changes, and vapor pressures, (d) provide expanded control and blending ranges, (e) provide tighter control of the blending process, (f) eliminate the need for multiple inputs which leads to additive variabilities, (g) provide not only an effective apparatus, but also effective processes for simultaneously blending-up tank heels and accommodating and adapting to significant fluctuations in the injection of other blend components, and/or (h) significantly decrease or eliminate the impact of butane supply pressure changes and variability.

SUMMARY OF THE INVENTION

The present invention provides an in-line blending system and method which alleviate the problems and satisfy the needs discussed above. The inventive in-line blending system and process allow accurate blending even down to a blending ratio of 0.25% and lower. This significantly expands summer blending capabilities and greatly increases blending volumes year round. In addition to greatly reducing the necessary safety margin between the blending target RVP versus the maximum allowable RVP specification for gasoline or other fuels, the precision of the inventive system and process allows the capture of blending differentials of as low as 0.125 RVP and less between (a) the blend target RVP and (b) the RVP of the gasoline or other fuels prior to blending.

Although, for purposes of convenience, the inventive apparatus, system, and process are discussed herein primarily in the context of blending butane and gasoline, it will be understood that each aspect of the inventive apparatus, system, and method discussed and shown herein is equally applicable to (a) the in-line blending of other fuel stocks and/or other blending stocks and (b) the general injection and blending of any first stream material with a second stream material. By way of example, but not by way of limitation, the inventive apparatus, system, and process can also be used for: (a) blending natural gasoline with gasoline; (b) blending alkylate with gasoline; (c) blending iso-butane with gasoline; (d) blending naphtha with gasoline; (e) blending raffinate with gasoline; (f) blending gasoline blend stock with gasoline; (g) blending gasoline with gasoline; and/or (h) blending other hydrocarbon blend stocks with gasoline or other fuel stocks.

In one aspect, there is provided a blending apparatus preferably comprising: one or more butane bullet tanks or other blending stock supply vessels; at least one injection pump which delivers butane and/or other blend stock to one or a plurality of lines carrying gasoline and/or other fuel stocks; an automated sampler and RVP analyzer or other vapor pressure analyzer which automatically samples and determines the RVP and/or other volatility parameters of the resulting blend at a point downstream of the injection point; and an automated controller which receives the data from the analyzer and preferably determines and implements an appropriate blend ratio based upon the downstream data in order to reach and maintain an RVP target and/or other volatility target value for the blend.

In another aspect, there is provided a method wherein the inventive system is used for blending butane with a batch, or a portion of a batch, of gasoline in a manner effective to also blend-up a tank heel already present in a tank or other vessel to which the blend is being delivered. The method preferably comprises the steps of: (a) determining the preblended volume of the incoming batch of gasoline or batch portion; (b) determining the tank heel volume (i.e., the volume of gasoline already present in the tank or other vessel prior to receiving the incoming batch); (c) determining the RVP of the tank heel (i.e., the RVP of the gasoline already present in the tank), preferably by sampling the tank; (d) determining the volume of butane needed to blend-up the heel to a desired RVP value; (e) determining the increase in the target RVP of the incoming batch or batch portion which will be needed in order to ensure that sufficient additional butane is injected into the incoming batch, or batch portion, to also blend-up the tank heel; and (f) adjusting the blending target RVP for the incoming batch or batch portion by adding the determined vapor pressure increase to the target RVP for the incoming batch. The necessary increase in target vapor pressure calculated in step (e) in order to also blend-up the tank heel will preferably be calculated by multiplying the desired increase in the vapor pressure of the tank heel by the volume of the tank heel and dividing by the volume of the incoming gasoline batch or batch portion.

In another aspect, this same method can be used for (a) blending butane with other fuel stocks, (b) blending other blend stocks with gasoline, and/or (c) blending other blend stocks with other fuel stocks, in a manner effective to also blend up (or down) a tank heel already present in a tank or other vessel to which the blend is being delivered.

In another aspect, there is provided a method of in-line addition of a blending stock (e.g., butane or other blending stock as described herein) to a fuel stock (e.g., gasoline or other fuel stock as described herein) to produce a blended product without exceeding an allowable volatility value for the blended product. The method preferably comprises the steps of:

(a) determining an arrival of the fuel stock flowing through a line, the line having an addition point for adding the blending stock;

(b) when the arrival of the fuel stock has been determined in accordance with step (a), initiating an analysis delay interval;

(c) when the analysis delay interval ends, automatically monitoring, at a point downstream of the addition point, an actual volatility value of the fuel stock or the blended product flowing through the line using an automated volatility analyzer, wherein the automated volatility analyzer is not operated to monitor the actual volatility value during the analysis delay interval; and (d) adding at the addition point, to the fuel stock flowing through the line, the blending stock at a blending stock addition rate which is automatically controlled by comparing the actual volatility value to a target volatility value for the blended product.

As used herein and in the claims, the term "volatility value" includes RVP, other vapor pressure values, vapor/liquid ratios, or any other volatility parameters.

The method can also optionally further comprise the step, prior to step (c), of determining that the batch of the fuel stock is of a type for which an addition of the blending stock is permissible. Such step of determining that the batch of the fuel stock is of a type for which an addition of the blending stock is permissible is preferably automatically performed by monitoring a signal indicating a valve alignment for delivery of the batch of the fuel stock through the line.

The target volatility value for the blended product can optionally be a target RVP or any other target vapor pressure ($VP_{target}$) and the actual volatility value can optionally be an actual RVP or any other actual vapor pressure ($VP_{actual}$). In addition, the method can be performed in a manner such that:

The fuel stock flows through the line in step (d) at a fuel stock flow rate.

When the actual vapor pressure ($VP_{actual}$) is less than the target vapor pressure ($VP_{target}$), the blending stock addition rate is controlled in step (d) in a manner to effectively implement automatic changes (Δ Blending %) to a current value of a blending percentage ratio (Blending % Ratio) to produce a new value of the blending percentage ratio (Blending % Ratio) such that:

the Blending % Ratio=[(the blend stock addition rate)/(the fuel stock flow rate)]×100%, the Δ Blending % is a value directly proportional to ($VP_{target}-VP_{actual}$), and the new value of the Blending % Ratio=the current value of the Blending % Ratio+the Δ Blending %.

It is most preferred that the Δ Blending %=($VP_{target}-VP_{actual}$)×(2/100).

Once again, as noted above, the term "vapor pressure," used herein and in the claims, includes RVP or any other vapor pressure value.

In another aspect, there is provided a method of in-line addition of butane to gasoline to produce a blended product without exceeding an allowable vapor pressure for the blended product, wherein the gasoline flows through a line having an addition point for adding the butane and the method preferably comprises the steps of:

(a) determining an arrival of the gasoline;

(b) when the arrival of the gasoline has been determined in accordance with step (a), initiating an analysis delay interval;

(c) when the analysis delay interval ends, automatically monitoring, at a point downstream of the addition point, an actual vapor pressure ($VP_{actual}$) of the gasoline or the blended product using an automated vapor pressure analyzer, wherein the automated vapor pressure analyzer is not operated to monitor the actual vapor pressure ($VP_{actual}$) during the analysis delay interval; and (d) adding at the addition point, to the gasoline flowing through the line, the butane at a butane addition rate which is automatically controlled by comparing the actual vapor pressure ($VP_{actual}$) to a target vapor pressure ($VP_{target}$) for the blended product.

This method can optionally be conducted wherein:

The gasoline flows through the line in step (d) at a gasoline flow rate.

When the actual vapor pressure ($VP_{actual}$) is less than the target vapor pressure ($VP_{target}$), the butane addition rate is controlled in step (d) in a manner to effectively implement automatic changes (Δ Blending %) to a current value of a blending percentage ratio (Blending % Ratio) to produce a new value of the blending percentage ratio (Blending % Ratio) such that:

the Blending % Ratio=[(the butane addition rate)/(the gasoline flow rate)]×100% the Δ Blending % is a value directly proportional to ($VP_{target}-VP_{actual}$), and the new value of the Blending % Ratio=the current value of the Blending % Ratio+the Δ Blending %.

It is most preferred that the Δ Blending %=($VP_{target}-VP_{actual}$)×(2/100).

In another aspect, there is provided a method of in-line addition of butane to gasoline to produce a blended product without exceeding an allowable Reid Vapor Pressure (RVP) for the blended product. The blended product has a target RVP ($RVP_{target}$) and the method preferably comprises the steps:

(a) delivering the gasoline through a line having an addition point for addition of the butane, the gasoline flowing through the line at a gasoline flow rate;

(b) automatically monitoring, at a point downstream of the addition point, an actual RVP ($RVP_{actual}$) the gasoline or the blended product flowing through the line using an automated RVP analyzer; and (c) adding the butane to the gasoline at the addition point at a butane addition rate which is automatically controlled.

When the actual RVP ($RVP_{actual}$) is less than the target RVP ($RVP_{target}$) of the product blend, the butane addition rate is preferably controlled in step (c) in a manner to effectively implement automatic changes (Δ Blending %) to a current value of a blending percentage ratio (Blending % Ratio) to produce a new value of the blending percentage ratio (Blending % Ratio) such that:

the Blending % Ratio=[(the butane addition rate)/(the gasoline flow rate)]×100%, the Δ Blending % is a value directly proportional to ($RVP_{target}-RVP_{actual}$), and the new value of the Blending % Ratio=the current value of the Blending % Ratio+the Δ Blending %.

This method is most preferably conducted such that:

the Δ Blending %=($RVP_{target}-RVP_{actual}$)×(2/100).

In another aspect, there is provided a method of in-line addition of a blending stock (e.g., butane or other) to a volume ($V_{FS}$) of a fuel stock (e.g., gasoline or other) flowing through a line to produce a blended product which flows to a tank, wherein the blended product has a blended product target vapor pressure (BTVP), the tank has a volume ($V_H$) of a tank heel material therein prior to receiving the blended product, the tank heel has an actual beginning tank heel vapor pressure ($VP_{THActual}$) which is less than a desired vapor pressure ($VP_{THDesired}$) for the tank heel material, and the line has an addition point for adding the blending stock. The method preferably comprises the steps of:

(a) determining an incremental increase (Δ VP) in the blended product target vapor pressure (BTVP) for the volume ($V_{FS}$) of the fuel stock wherein $$\Delta VP=(V_H/V_{FS})\times(VP_{THDesired}-VP_{THActual});$$

(b) determining a modified blended product target vapor pressure (MBTVP) for the volume ($V_{FS}$) of the fuel stock wherein $$MBTVP=BTVP+\Delta VP;$$

(c) automatically monitoring, at a point downstream of the addition point, an actual vapor pressure ($VP_{Actual}$) of the fuel stock or the blended product using an automated vapor pressure analyzer; and (d) adding at the addition point to the volume ($V_{FS}$) of the fuel stock flowing through the line the blending stock at a blending stock addition rate which is automatically controlled by comparing the actual vapor pressure ($VP_{Actual}$) to the modified blended product target vapor pressure (MBTVP) for the volume ($V_{FS}$) of the fuel stock.

This method can also be conducted such that:

The volume ($V_{FS}$) of the fuel stock flows through the line in step (d) at a fuel stock flow rate.

When the actual vapor pressure ($VP_{Actual}$) is less than the modified blended product target vapor pressure (MBTVP), the blending stock addition rate is controlled in step (d) in a manner to effectively implement automatic changes (Δ Blending %) to a current value of a blending percentage ratio (Blending % Ratio) to produce a new value of the blending percentage ratio (Blending % Ratio) such that:

the Blending % Ratio=[(the blending stock addition rate)/(the fuel stock flow rate)]×100%, the Δ Blending % is a value directly proportional to ($MBTVP-VP_{Actual}$), and the new value of the Blending % Ratio=the current value of the Blending % Ratio+the Δ Blending %.

The method is most preferably conducted such that:

$$\text{the } \Delta \text{ Blending } \%=(MBTVP-VP_{Actual})\times(2/100).$$

Further aspects, features, and advantages of the inventive system, apparatus, and process will be apparent upon examining the accompanying drawings and upon reading the following detailed description of the preferred embodiments.

DETAILED DESCRIPTION OF THE PREFERRED EMBODIMENTS

Figure 3:
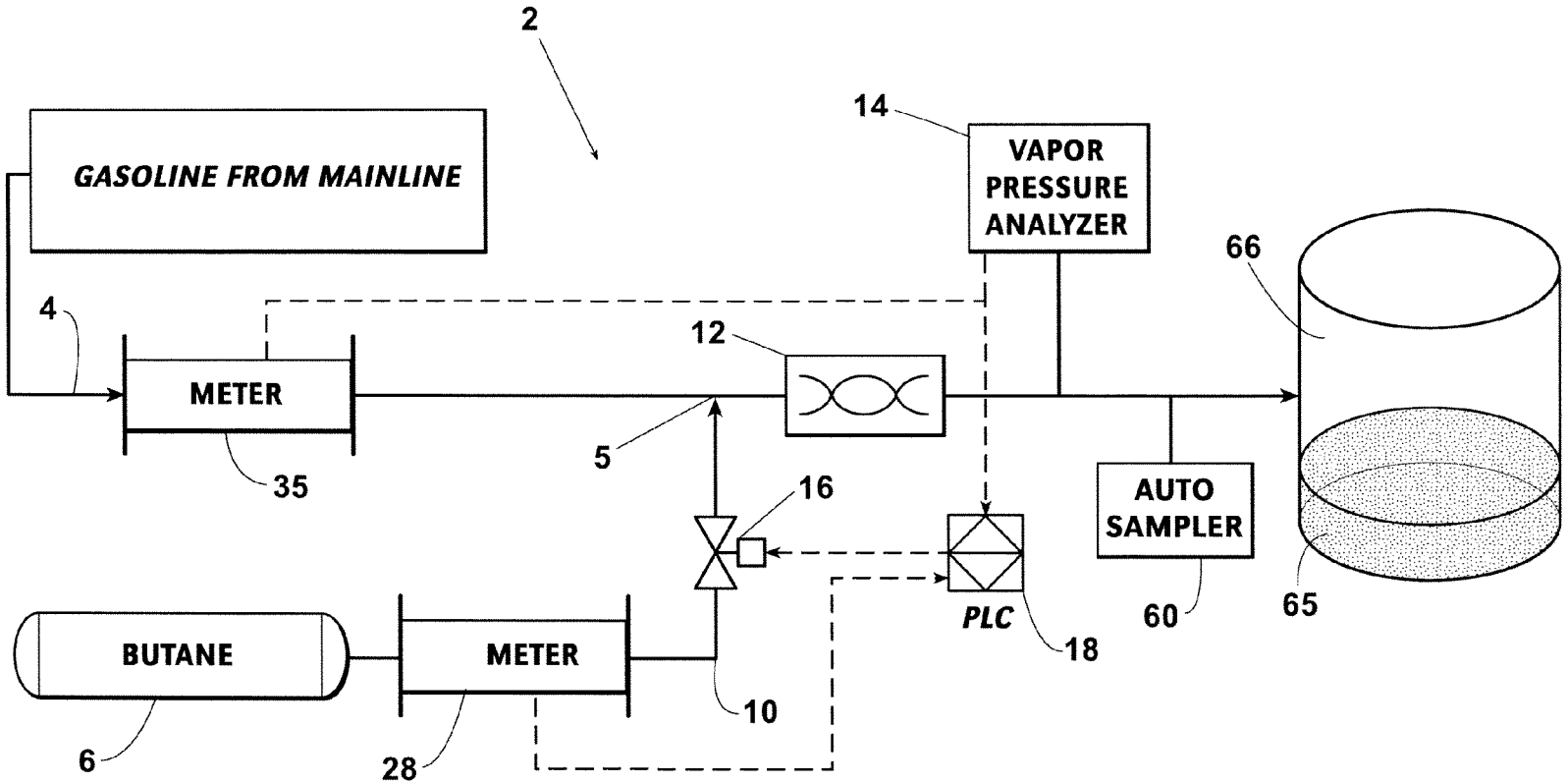
FIG. 3 illustrates the use of the inventive in-line blending apparatus and system 2 for also blending-up a tank heel volume 65 which is already present in a tank or other vessel 66 prior to the delivery of an incoming batch, or batch portion, of gasoline and/or other fuel stock.

An embodiment 2 of the inventive in-line blending system and method is illustrated in FIGS. 12, and 3. In the inventive system 2, butane and/or other blend stock is blended with a stream of gasoline or other fuel stock flowing through a line 4. By way of example, but not by way of limitation, the line 4 can be (a) a main line or other line 4*a* of a petroleum pipeline system, (b) a line 4*b* or 4*c* running to a dedicated rack tank 15 or other tank, or (c) any other line.

Examples of fuel stocks which can be delivered through line 4 for blending purposes include, but are not limited to: gasoline; reformulated blend stock (RBOB); conventional blend stock (CBOB); ethanol; diesel; jet fuel; and/or other hydrocarbons. Examples of blending stocks which can be injected into the fuel stock stream traveling through line 4 include, but are not limited to: butane; natural gasoline; alkylate; iso-butane; naphtha; raffinate; gasoline blend stock materials; gasoline; and/or other hydrocarbons.

By way of example, in terms of blending butane with gasoline, the inventive blending system 2 preferably comprises: one or more, preferably a plurality of, butane bullet tanks 6 or other pressurized butane storage vessels; one or more butane injection pump(s) 8 which deliver butane from the tank(s) 6 to the gasoline line 4 via a butane injection line 10; a static mixer or other mixer 12 installed in the gasoline line 4 downstream of the butane injection point 5 for mixing the butane with the gasoline stream; an online sampler and RVP analyzer 14 which automatically samples and determines the RVP of the gasoline/butane blend in the gasoline line 4 at a point downstream of the butane injection point 5 and downstream of the mixer 12; a flow control valve 16 or other controller (e.g., a variable frequency drive) provided in the butane injection line 10; and a programmable logic controller (PLC) or other automated controller 18 which receives the RVP data from the downstream analyzer 14, determines an appropriate butane blend ratio based upon the RVP data, and implements the calculated blending ratio by automatically operating the butane control valve 16 and/or the butane pump 8. It will be understood, however, that butane may alternatively be taken from a main line or any other source so that a butane storage vessel is not required.

Figure 1:
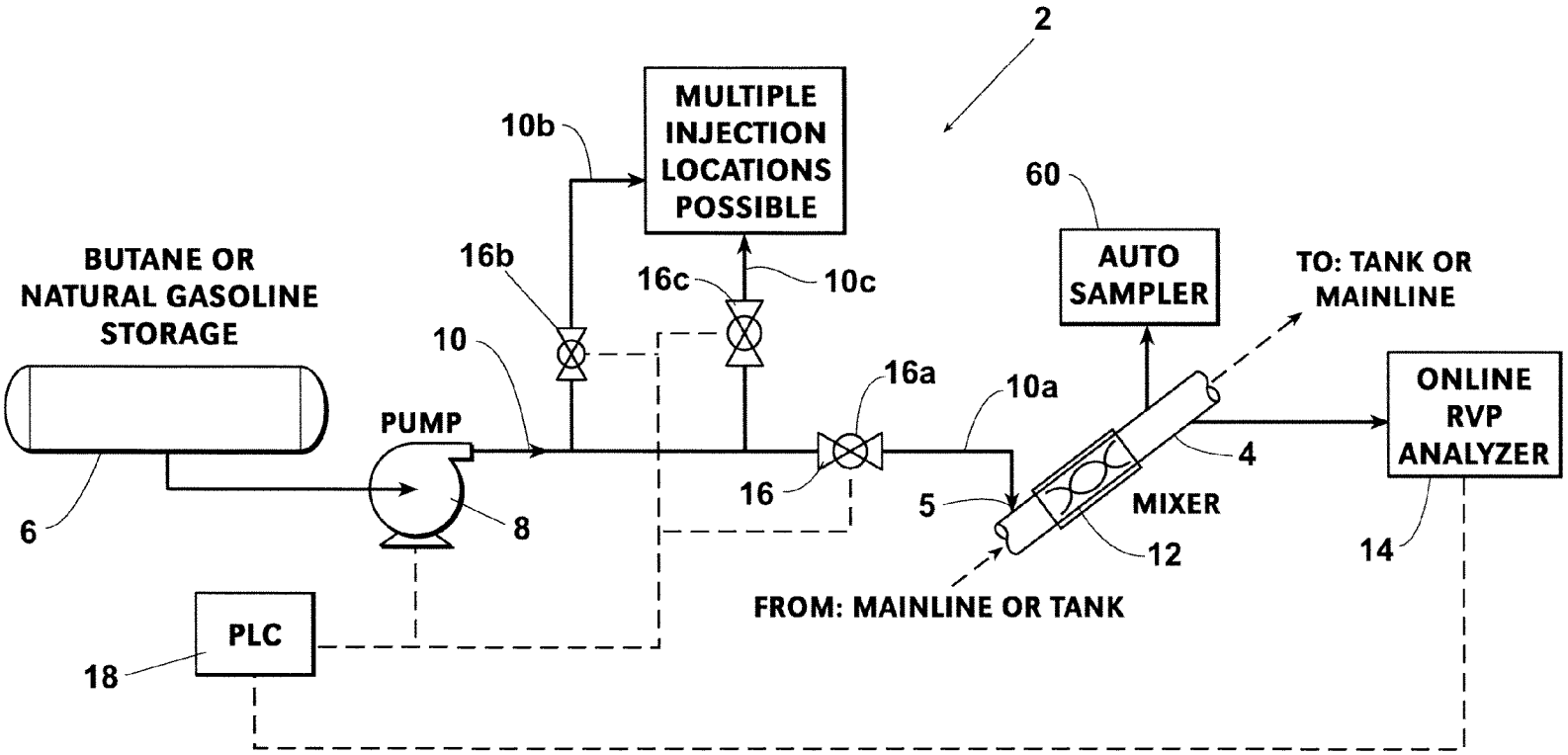
FIG. 1 schematically illustrates an embodiment 2 of the inventive in-line blending apparatus, process, and system.
Figure 2:
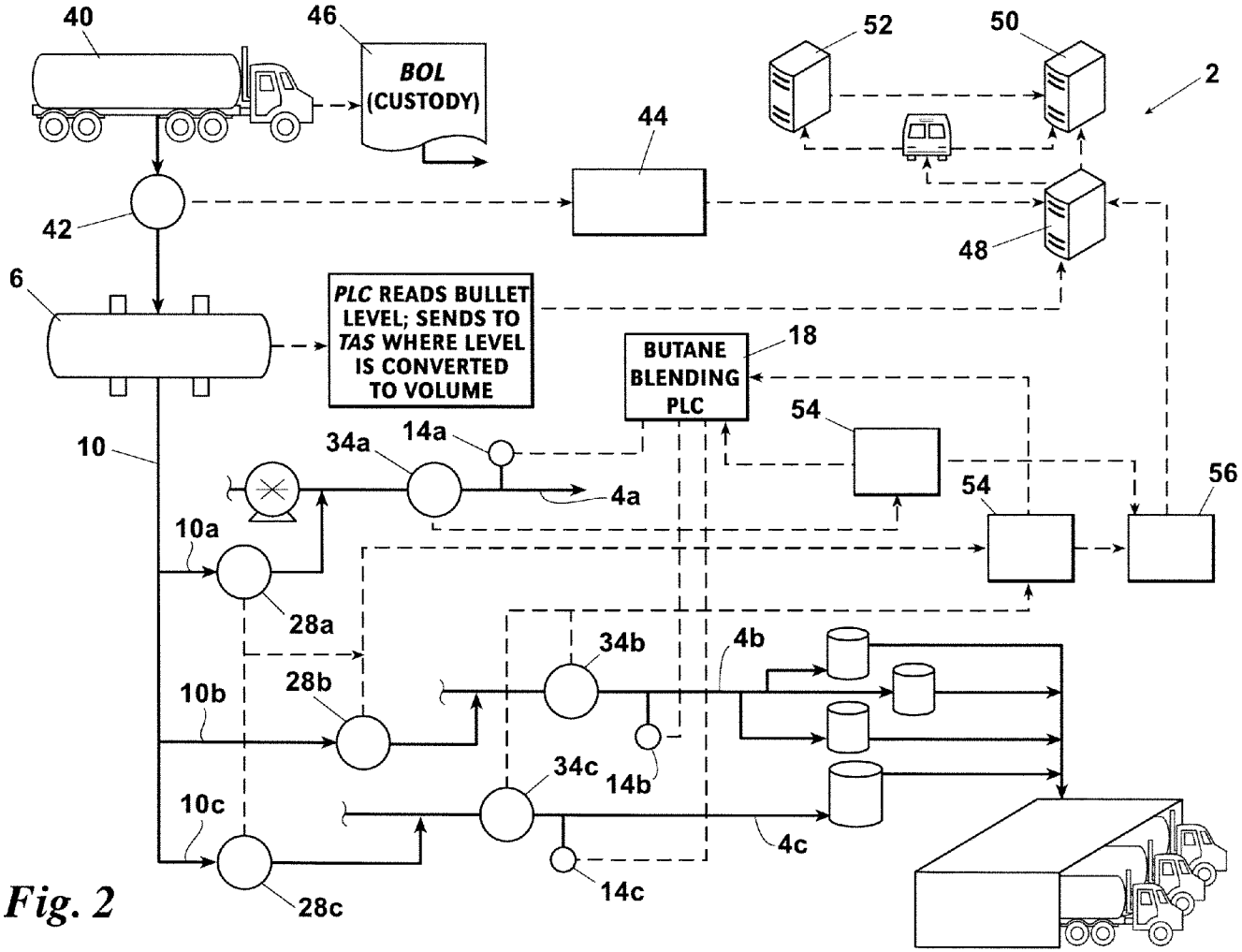
FIG. 2 is a schematic diagram which further illustrates and shows additional features of the inventive in-line blending apparatus, process and system 2.

In addition, the inventive system 2 can include (a) a flow meter or other device 35 in line 4 upstream of the injection point 5 (as illustrated in FIG. 3) for measuring pre-blended gasoline and/or (b) a flow meter or other device 34*a*, 34*b*, 34*c* downstream of the injection point 5 as illustrated in FIG. 2 for measuring blended gasoline. Further, it will be understood that, alternatively or in addition to measuring and controlling based upon RVP, the analyzer 14 and the control system 18 could measure and operate based upon other types of vapor pressure readings, vapor to liquid ratios, and/or other volatility parameters.

As illustrated in FIG. 2, the inventive system can actually include any number of multiple injection lines 10*a*, 10*b*, 10*c* for blending butane and/or or other blend stocks with gasoline and/or other fuel stock streams flowing through multiple different lines 4*a*, 4*b*, 4*c* of any type. Each injection line 10*a*, 10*b*, 10*c* preferably includes an injection flow meter or other measuring device 28*a*, 28*b*, 28*c*. In addition, a blend flow meter or other measuring device 34*a*, 34*b*, 34*c* is preferably provided in each blend line 4*a*, 4*b*, 4*c* downstream of the injection points along with an online sampler and RVP analyzer 14*a*, 14*b*, 14*c*. Alternatively, a single RVP analyzer can be used which is capable of switching between multiple streams 4*a*, 4*b*, 4*c*.

In the inventive method for butane blending, the butane can be supplied to the butane tank(s) 6 in generally any manner and will typically be delivered by butane transport trucks 40 and/or pipeline. The quantity of butane delivered by each truck 40 and/or pipeline to the butane tank(s) 6 will preferably be measured by an in-line flow meter or other device 42. This information will then preferably be automatically transmitted to a flow computer system 44 which interfaces the transfer from the butane truck 40 or pipeline to the butane blending system 2. In addition, information from the bill of lading (BOL) 46 for each truck 40 will also preferably be entered into the terminal automation system interface 44 either by hand using a keyboard or touch screen or automatically by, e.g., data scan or other procedure. The information entered from the BOL 46 will preferably include: volume; supplier; carrier; well or tank source; driver name; date; time; and/or product grade of the butane.

The information entered into and/or received by the flow computer interface 44 will preferably be automatically transmitted to a terminal automation system 48 which is capable of monitoring and even controlling the blending operation either onsite or from a remote location. Relevant information received and transmitted by the terminal automation system 48 will also preferably be transmitted to an inventory and accounting software program system 50 and associated database 52. In addition, data from the butane tank(s) 6 is preferably also transmitted to the terminal automation system 48 either automatically or by user interface. This information will preferably include: tank liquid levels; pressure; volume recorded on BOL; volume of butane that was measured; supplier; carrier; date; product grade of butane; gasoline product grade that the butane was blended into; and/or the volume of butane blended.

The truck off-loading butane measurement system included in the inventive system 2 provides various benefits and advantages. For example, the system provides knowledge of the exact volume of butane being off-loaded, provides verification of tank and injection measurements, and/or provides the ability to determine whether the correct type of butane is being received, or whether the shipment is actually even butane at all. Knowledge of the actual volume of butane off-loaded also allows the operator to determine if the volume indicated on the BOL is accurate and to verify whether the various tank and injection measurement devices of the inventive system 2 are accurate and functioning properly. Further, the off-loading measurement allows the operator and/or system to monitor and activate an alarm if the pressure and/or density of the butane off-loaded is/are significantly different than the specifications for the butane supply.

For each sequential batch of gasoline or other fuel stock which is or will be delivered through any line served by the inventive blending system 2 (e.g., line 4*a*, 4*b*, or 4*c*), the terminal operator will preferably enter a predetermined butane blending RVP target, or other blending volatility target for the batch, as well as the batch size, into a flow computer system 54. Alternatively, this information can be automatically transmitted to the flow computer system 54, or to some extent already stored in the system 54 in the case, for example, of target vapor pressure data and other parameters for certain grades of gasoline.

The flow computer system 54 preferably (a) receives data regarding gasoline custody transfers and incoming flows of gasoline or other fuel stock through the line(s) 4, (b) receives further information regarding the incoming gasoline or fuel stock flows such as pressure, temperature, and flow rate (volumetric or mass), (c) receives and reports flow data from the injection meters 28*a*, 28*b*, 28*c* and the blend flow meters 34*a*, 34*b*, 34*c*, (d) preferably transmits all of the information it receives to an additional flow computer system 56 which is linked to the terminal automation system 48 and inventory and accounting software system 50 and (e) also preferably transmits the blend RVP or other targets, batch volumes, and other information to the blending programmable logic controller (PLC) 18. The additional flow computer system 56 is preferably used for the purpose(s) of tracking all blend volumes for accounting purposes and government reporting. This includes butane, gasoline, and other blend stocks.

Alternatively, the blend RVP target(s) (or other volatility target(s)) and incoming batch volumes of gasoline and/or other fuel stocks can be automatically transmitted to the PLC 18. In addition, the PLC 18 or other calculation device can be used to calculate other RVP or volatility targets, e.g., for blending tank heels or for creating blend stocks for downstream tankage blending. As used herein, and as illustrated in FIG. 3, the term "tank heel" refers to the volume 65 of gasoline or other fuel stock already present in a tank or other vessel 66 prior to receiving a new batch of gasoline or other product. The new batch of gasoline or other product will be delivered to the tank 66 via the inventive blending system 2.

The use of the inventive blending system 2 for blending-up a tank heel 65 is illustrated in FIG. 3. It is desirable and beneficial to "blend-up" a tank heel 65 when the actual vapor pressure (i.e., RVP or other vapor pressure or volatility parameter) is below the maximum allowable vapor pressure specification for the heel 65 so that an available vapor pressure margin exists. When using the inventive system and process 2 for blending-up a tank heel 65, the inventive blending process 2 preferably operates by increasing (either automatically or manually) the target vapor pressure of the incoming batch or batch portion of gasoline or other fuel stock by an amount whereby, by blending the incoming batch to meet the modified RVP target (or other modified volatility target), the extra amount of butane or other blend stock added to the batch of gasoline or other fuel stock flowing through line 4 will be effective such that, when the batch is received in the tank 66, the entire volume 66 in the tank, including the heel 65, will now meet the target vapor pressure or volatility.

The modified batch target vapor pressure (MBTVP) necessary for causing the inventive system to automatically add an incremental amount of butane or other blend stock to the incoming batch sufficient for also blending-up the tank heel 65 will preferably be determined in accordance with the following:

$$MBTVP=BTVP+\Delta VP$$

$$\Delta VP=(V_H/V_B)*(VP_{HT}-VP_{HA})$$

wherein:

MBTVP=modified batch target vapor pressure for the incoming batch or batch portion of gasoline or other fuel stock BTVP=batch target vapor press for blending the batch alone (i.e., without also blending up the tank heel)

ΔVP=the incremental increase in target vapor pressure for the batch or batch portion necessary to also blend-up the tank heel $VP_{HT}$=target vapor pressure for the tank heel $VP_{HA}$=actual vapor pressure of the tank heel $V_H$=tank heel volume $V_B$=volume of incoming batch or batch portion It will be noted and understood that these same formulas sometimes appear in other locations herein and in the claims wherein the symbols for the variables or values may be changed slightly for purposes of greater clarity in the particular context discussed.

As will also be understood, these same formulas and this same process can also be used, if needed, to adjust the target vapor pressure of an incoming batch or batch portion of gasoline or other fuel stock in a manner effective for "blending-down" an off spec tank heel 65 having a vapor pressure which is above the maximum allowable specification for the blend.

Figure 4:
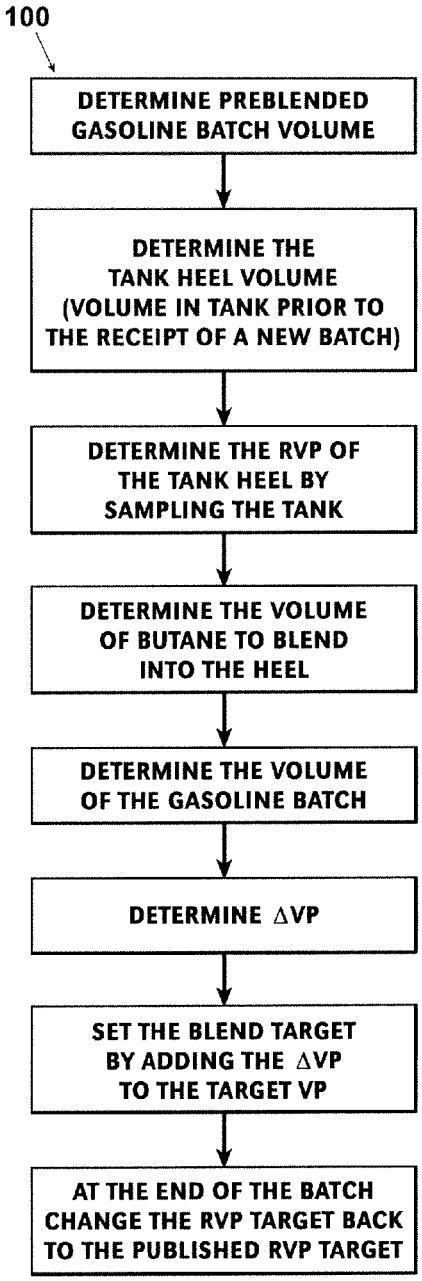
FIG. 4 is a flowchart illustrating an embodiment 100 of the inventive process wherein a sufficient incremental amount of butane is also injected into an incoming batch of gasoline in order to blend-up a tank heel which is already present in a tank or other vessel.

A flow diagram illustrating an embodiment 100 of the inventive method for blending-up a tank heel 65 using an entire incoming batch of gasoline is provided in FIG. 4. It will be understood that the process shown and described can alternatively be used for blending (a) other stocks instead of or along with butane with (b) other fuel stocks instead of or along with gasoline. The inventive method 100 preferably comprises the steps of:

a. receiving and/or entering (i) the volume ($V_B$) of the incoming (i.e., not yet blended) batch of gasoline and (ii) the gasoline product grade which, along with the location, season, and any other factors, establishes the relevant maximum vapor pressure specification for the blend (and which, after factoring in the margin of safety necessary to reliably account for system accuracy and variability, also establishes an acceptable batch target vapor pressure (BTVB) for the blend);

b. prior to receiving the batch, determining either automatically or manually the volume of the tank heel 65 which is present in tank 66;

e. determining the actual vapor pressure ($VP_{HA}$) of the tank heel 65 preferably by sampling (preferably by composite sampling using, e.g., samples taken from the top, middle, and bottom of the heel 65);

d. calculating, in accordance with the formula set forth above, the incremental increase ($\Delta VP$) in target vapor pressure for the batch necessary to also blend up the tank heel 65;

e. determining the modified batch target vapor pressure (MBTVP) for the incoming gasoline batch in accordance with the formula set forth above;

f. using the inventive system 2 to blend butane with the gasoline batch to meet the modified batch target vapor pressure (MBTVP); and g. at the end of the batch, setting the target vapor pressure back to the original (i.e., unmodified) batch target vapor pressure (BTVP).

Figure 5:
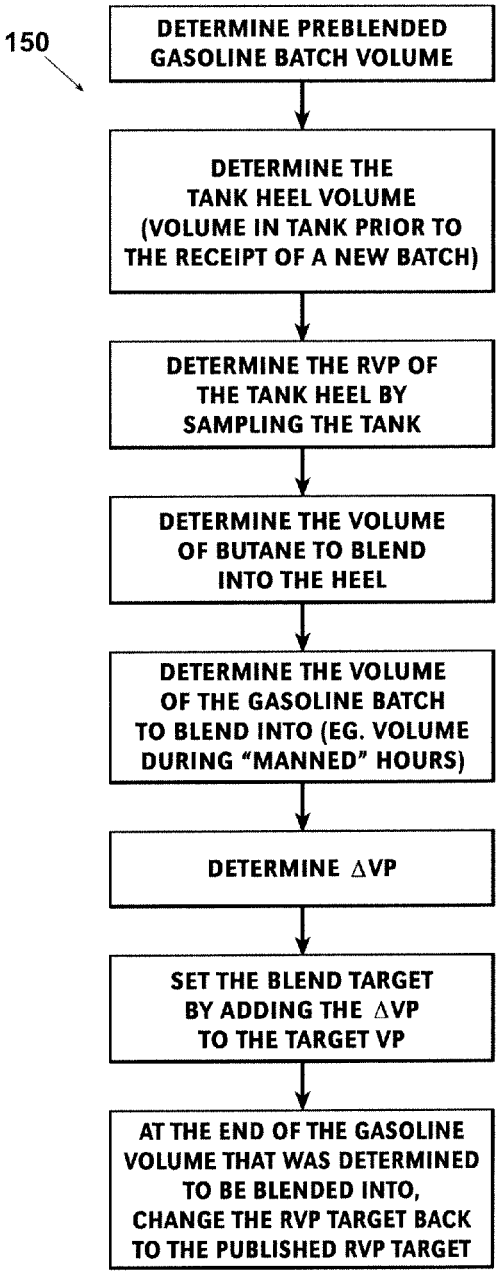
FIG. 5 is a flowchart illustrating an alternative embodiment 150 of the inventive process wherein a portion of an incoming gasoline batch is used for blending-up a tank heel.

Similarly, a flow diagram is provided in FIG. 5 of an embodiment 150 of the inventive method wherein the tank heel 65 is blended-up using only a portion, rather than all, of the incoming new batch of gasoline. The use of only a portion of the incoming batch of gasoline and/or other fuel stock to blend-up the tank heel 65 may be preferred or necessary when, e.g., a latter portion of the incoming batch will be delivered to a different tank, or when it is desired to complete the blending-up operation within a certain time frame ending prior to the delivery of the entire batch (e.g., during manned hours at the blending facility).

When using either embodiment 100 or 150 for blending-up the tank heel 65, it is also desirable to again test the tank following the blending operation to ensure that the entire content of the tank 66 complies with the vapor pressure specification (and/or other volatility specification) for the resulting tank blend.

The batch size of the gasoline or other fuel stock can also be used for determining a preferred or optimum sampling frequency for an autosampler system 60 linked to the line 4 downstream of the blending point 5. For gasoline, the autosampler system 60 is preferably a refined or light hydrocarbon composite autosampler such as a YZ or Welker system or other commercially available autosampling system. The autosampler 60 will preferably be controlled by the PLC 18, or other automated controller, to draw samples providing a composite of the blended stream. Also, the autosampler system 60 may, for example, utilize a grab valve for transferring a portion of an automatically collected composite sample to a sample bottle for testing. The data obtained can be used for, e.g., verifying the precision and accuracy of the blending system, determining other properties and parameters not tested by the online analyzer 14, and/or providing backup data for compliance.

For each batch of gasoline or other fuel stock which is scheduled to flow through the inventive blending system 2, the PLC 18 will read the flow meter pulses and other information from the flow computer system 54 to determine if the batch has arrived and whether there is flow in the line 4. The grade and/or other relevant parameters of the incoming batch may (a) be known and entered by the operator, (b) automatically determined by, e.g., storage tank valve alignment data which is received by the flow computer system 54 and transmitted to the PLC 18, and/or (c) automatically transmitted by other means. Based upon the information entered and/or received, the appropriate blending RVP target or other volatility target for the batch in question is entered into the PLC 18.

The PLC 18 also preferably determines if there are any active system alarms at the moment. If yes, the process will, if required, be automatically stopped or restarted. Examples of possible system alarms could include: low butane vessel levels; RVP failure (e.g., validation failure); HAZGAS (e.g., high alarm); flow rate more than 5% above set point for prolonged period; flow rate too low to fall within control range; no flow rate; emergency shutdown (push button); butane pump seal leak; high pressure in butane vessel; high temperature in butane vessel; butane discharge pressure too high; auto-sampler level too high; etc.

The emergency shutdown system and emergency shutdown parameters for the inventive process and system are also preferably integrated with the entire emergency shutdown system at the blending or operational site. The integration will preferably be such that, when relevant, the emergency shutdown system for the inventive blending system will also shut down other operations at the site, and vice versa. This improves overall site safety and reduces the possibility that problems associated with the faulty operation or shutdown of one process or system will affect the others.

When each new batch of gasoline or other fuel stock arrives through the line 4, the PLC 18 preferably begins an appropriate delay (typically about five (5) minutes) to ensure that the batch interface has passed the sample inlet of the online analyzer 14.

The delay in initiating testing by the online analyzer 14 between succeeding batches ensures that accurate data is obtained and transmitted to the blending system. One benefit is that the sampling delay reduces contamination between gasoline batches and decreases the time required for the online analyzer 14 to return an accurate analysis. This also allows the operator to maximize the amount of butane blended into each batch of gasoline. Further, the sampling delay reduces the likelihood that the online analyzer 14 will be contaminated or damaged by any batch of non-gasoline fuel which may also be delivered through the line 4.

The duration of the delay period is preferably determined by (a) quality control considerations (e.g., the tolerance of the preceding product batch for butane addition) and/or prohibitions against blending butane or other blend stock into the preceding product and (b) line considerations such as flow rate, flow pressure, environmental permits for transmix tanks at locations which will receive the blended gasoline or other blended fuel stock, and/or whether the batch could potentially be partitioned at a downstream location.

Conditions which could require that the delay period be lengthened include the inability of the preceding batch material (e.g., jet fuel or diesel) to tolerate butane addition. In addition, if it is believed that the batch has very little or no RVP margin, the blending may be delayed to determine the magnitude of the margin, if any.

Conditions which could allow the delay period to be shortened include situations where the preceding batch is being blended as well. This is often the case with two successive batches of gasoline. Additionally, when the interface between two succeeding batches is not going to be cut into a transmix tank, the injection delay may be reduced to the point where injection is not suspended between the batches.

The innovative system and process can also be operated to begin blending even before any data regarding the current batch of gasoline or other fuel stock has been transmitted to the PLC 18 by the online analyzer 14. For example, for any given batch for which blending is permitted and it is also known that at least some available RVP margin exists, an initial safe blending default ratio (e.g., 0.25%) could be entered or otherwise activated. Alternatively, as another example, an operator can enter a predetermined blending value for the batch.

At the end of the interface delay, the PLC 18 commands the online analyzer 14 to begin sampling and testing. Based upon the test results and the blending target for the batch in question, the PLC 18 calculates an appropriate blend ratio. By way of example, for blending butane with gasoline and for similar operations, the blend ratio will preferably be calculated according to the following formula:

$$\Delta \text{ Blending } \% = (VP_{target} - VP_{actual}) * (2/100)$$

wherein:

Δ Blending %=the initial ratio or subsequent change in the ratio of butane injection volume to gasoline volume implemented by the system to meet the target vapor pressure $VP_{target}$=target vapor pressure (RVP or other) for the blend $VP_{actual}$=vapor pressure of the blend as measured by the online analyzer 14.

It will be noted and understood that this same formula sometimes appears in other locations herein and in the claims wherein the symbols for the variables or values may be changed slightly for purposes of greater clarity in the particular context discussed.

This procedure effectively assumes a vapor pressure of the butane rather than having to monitor and use an actual value. Thus, in the inventive system, the PLC 18 provides a quick step response with a low probability of overshooting the target. Eliminating the need to accurately determine and use an actual butane vapor pressure also simplifies trouble-shooting and improves the predictability of the inventive blending system.

Further, the inventive system and process preferably also provide an operator override which can ensure accurate injection based upon, e.g., local procedures. The procedure will preferably instruct the local operator to spot check the RVP and/or other control parameter downstream of the injection point to ensure that on-spec conditions are achieved. This provides the operator or system the ability to modify the equation for control step changes such as, e.g., a modifier or variable for a RVP input. For example, an RVP modifier could be used to reduce or increase the RVP to ensure that the RVP matches a reference machine that is performing the actual EPA/ASTM RVP measurement.

Based upon the calculated blending ratio for the batch and the flow volume information provided by the flow meter 34*a*, 34*b*, 34*c*, or 35, the PLC 18 determines an appropriate injection volume rate for the butane or other blend stock and initiates and/or changes the injection volume by starting the pump 8, opening any isolation valves, and/or opening and controlling the relevant injection flow control valve 16*a*, 16*b*, 16*c*. The PLC 18 also preferably activates the blend autosampler system 60, as well as an autosampler system (not shown) for the butane or other blend stock. The autosampler system for the blend stock preferably operates to determine the blend stock quality (e.g., on a monthly composite or other basis).

Given the continuing information provided by the online analyzer 14 regarding the actual RVP or other volatility parameter of the blend, the PLC 18 continuously operates (preferably using a proportional-integral-derivative control loop) to adjust the butane or other injection rate as necessary to achieve and maintain the targeted blend volatility (e.g., RVP) for the batch in question. The blending procedure for a given gasoline or fuel batch will preferably be ended by the PLC 18 when, e.g., an end of batch signal is received from the flow computer system 54, the gasoline or fuel stock flow rate drops below a minimum set point, or an alarm condition occurs.

Reports concerning each blend, reports for each two hour or other time period, daily reports, and/or other desired reports will preferably be issued automatically by the PLC 18 or other system database. Any desired volume, rate, blend, analysis, or other data received by the PLC 18 or flow computer 54, or any desired combination thereof, can be provided. The report data for each blend will preferably include: butane blended volume; pre-blending and/or post-blending gasoline volume; gasoline product grade; time and date; RVP (and/or other vapor pressure); and/or butane product grade. For accounting and other purposes, the inventive system will also preferably reclassify the blended butane as gasoline in the inventory/accounting software and record RVP attributes for the gasoline produced.

The inventive apparatus and system provide tremendous reductions in control variability. This reduced variability greatly increases the injection precision of the inventive process and system and allows the inventive system to produce gasoline blends which consistently hit the RVP target. As a result, the inventive system and process greatly reduce the necessary margin of safety between the target RVP and the maximum allowable RVP specification for the gasoline blend, thus maximizing the amount of blending which can occur.

The inventive system preferably continuously adjusts the blend ratio based solely on the finished volatility of the blended gasoline or other fuel stock, rather than upon a calculated (predicted) blend vapor pressure requiring accurate knowledge of multiple upstream factors. Thus, the inventive system reduces the introduction of error caused by the integration of multiple analyzer and meter inputs and removes the need for highly accurate injection meters. Further, the inventive system greatly simplifies troubleshooting and maintenance by allowing the operator to concentrate primarily on the performance and accuracy of the online analyzer 14 located downstream of the injection point 5. The consistent high degree of accuracy provided by the inventive system and process also makes the inventive system and process ideal for simultaneously blending-up tank heels.

Because the determinative measurement for the inventive system and process is the RVP or other volatility parameter of the blend downstream of the injection point, any variability in (a) the supply vapor pressure of the butane or other blend stock and/or (b) feedstock quality is/are substantially rendered inconsequential. The same is also the case regarding fluctuations in rates for any W grade natural gasoline, transmix, or other components which may be concurrently injected into the blend upstream of the analyzer reading.

In addition, in order to further increase the accuracy of the inventive system and continuously reduce, e.g., the margin between target RVP and the maximum allowable RVP specification for gasoline, the precision of the inventive system is preferably assessed on an ongoing basis using data generated from the online analyzer 14 and the autosampler 60. Statistical review of the data is used to determine the need to adjust the volatility (e.g., RVP) control set point and to also identify problem areas and potential improvements.

It is also noted that, though control of the blending operation is typically based upon the vapor pressure (i.e., RVP or other vapor pressure) of the blended product, it may also be necessary that the finished product conform to a vapor-to-liquid ratio or other volatility specification. Assurance of conformance to any vapor-to-liquid or other volatility specification is provided by the collection and testing of the samples of the finished blend. The results of these tests are evaluated to determine whether the butane injection rate may actually be limited by the alternative specification rather than by RVP. If so, an appropriate reduction or other change to the target RVP can be implemented or an alternative type of online volatility analyzer can be used to more directly measure and use the critical volatility parameter.

Moreover, since the controlling parameter (e.g., RVP, vapor-to-liquid ratio, etc.), is a function of the composition of the gasoline or other fuel stock that is being blended, the controlling parameter in many cases may be origin dependent. The test results for the finished blend, coupled with the knowledge of the source of the gasoline or other fuel stock, will in many cases enable the establishment of control limits that are source specific.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A method of in-line addition of a blending stock to a batch of fuel stock flowing through a line to produce a batch of blended product without exceeding an allowable volatility value for said batch of blended product, said method comprising the steps of:

(a) determining an arrival of an interface between said batch of fuel stock flowing through said line and a previous batch of material flowing through said line immediately ahead of said batch of fuel stock, said line having an addition point for adding said blending stock and said line having a sampling point for an automated volatility analyzer downstream of said addition point;

(b) when said arrival of said interface between said batch of fuel stock and said previous batch of material has been determined in accordance with step (a), initiating an analysis delay interval during which said automated volatility analyzer is prevented from taking samples from said sampling point;

(c) terminating said analysis delay interval when said interface between said batch of fuel stock and said previous batch of material has passed said sampling point so that said automated volatility analyzer is activated to automatically monitor an actual volatility value of said batch of fuel stock or said batch of blended product downstream of said addition point by automatically taking and testing samples at said sampling point; and (d) adding at said addition point to said batch of fuel stock flowing through said line said blending stock at a blending stock addition rate which is automatically controlled by comparing said actual volatility value to a target volatility value for said batch of blended product.

2. The method of claim 1 wherein said blending stock is not added to said batch of fuel stock during said analysis delay interval but is added to said batch of fuel stock when said analysis delay interval is terminated.

3. The method of claim 1 further comprising the step, prior to step (c), of determining that said batch of fuel stock is of a type for which an addition of said blending stock is permissible.

4. The method of claim 3 wherein said step of determining that said batch of fuel stock is of a type for which an addition of said blending stock is permissible is automatically performed by monitoring a signal indicating a valve alignment for delivery of said batch of fuel stock through said line.

5. The method of claim 1 wherein:

said target volatility value for said batch of blended product is a target vapor pressure ($VP_{target}$) and said actual volatility value is an actual vapor pressure ($VP_{actual}$), said batch of fuel stock flows through said line in step (d) at a fuel stock flow rate and, when said actual vapor pressure ($VP_{actual}$) is less than said target vapor pressure ($VP_{target}$), said blending stock addition rate is controlled in step (d) in a manner to effectively implement automatic changes (Δ Blending %) to a current value of a blending percentage ratio (Blending % Ratio) to produce a new value of said blending percentage ratio (Blending % Ratio) such that:

said Blending % Ratio=[(said blending stock addition rate)/(said fuel stock flow rate)]×100%, said Δ Blending %=$C\times(VP_{target}-VP_{actual})$, C is a proportionality constant, and said new value of said Blending % Ratio=said current value of said Blending % Ratio+said Δ Blending %.

6. A method of in-line addition of butane to a batch of gasoline flowing through a line to produce a batch of blended product without exceeding an allowable vapor pressure for said batch of blended product, wherein said line has an addition point for adding said butane and said line has a sampling point for an automated vapor pressure analyzer downstream of said addition point, said method comprising the steps of:

(a) determining an arrival of an interface between said batch of gasoline flowing through said line and a previous batch of material flowing through said line immediately ahead of said batch of gasoline;

(b) when said arrival of said interface between said batch of gasoline and said previous batch of material has been determined in accordance with step (a), initiating an analysis delay interval during which said automated vapor pressure analyzer is prevented from taking samples from said sampling point;

(c) terminating said analysis delay interval when said interface between said batch of gasoline and said previous batch of material has passed said sampling point so that said automated vapor pressure analyzer is activated to automatically monitor an actual vapor pressure ($VP_{actual}$) of said batch of gasoline or said batch of blended product downstream of said addition point by automatically taking and testing samples at said sampling point; and (d) adding at said addition point, to said batch of gasoline flowing through said line, said butane at a butane addition rate which is automatically controlled by comparing said actual vapor pressure ($VP_{actual}$) to a target vapor pressure ($VP_{target}$) for said batch of blended product.

7. The method of claim 6 wherein said butane is not added to said batch of gasoline during said analysis delay interval but is added to said batch of gasoline when said analysis delay interval is terminated.

8. The method of claim 6 further comprising the step, prior to step (c), of determining that said batch of gasoline is of a type for which an addition of said butane is permissible.

9. The method of claim 8 wherein said step of determining that said batch of gasoline is of a type for which an addition of said butane is permissible is automatically performed by monitoring a signal indicating a valve alignment for delivery of said batch of gasoline through said line.

10. The method of claim 6 wherein:

said batch of gasoline flows through said line in step (d) at a gasoline flow rate and, when said actual vapor pressure ($VP_{actual}$) is less than said target vapor pressure ($VP_{target}$), said butane addition rate is controlled in step (d) in a manner to effectively implement automatic changes (Δ Blending %) to a current value of a blending percentage ratio (Blending % Ratio) to produce a new value of said blending percentage ratio (Blending % Ratio) such that:

said Blending % Ratio=[(said butane addition rate)/(said gasoline flow rate)]×100%, said Δ Blending %=$C\times(VP_{target}-VP_{actual})$, C is a proportionality constant, and said new value of said Blending % Ratio=said current value of said Blending % Ratio+said Δ Blending %.

11. The method of claim 10 further comprising adding a natural gasoline material to said batch of gasoline in said line at a point prior to said sampling point at which said actual vapor pressure ($VP_{actual}$) is monitored in step (c), said natural gasoline material being different from said batch of gasoline, said butane, and said previous batch of material.

12. The method of claim 10 further comprising adding a transmix material to said batch of gasoline in said line at a point prior to said sampling point at which said actual vapor pressure ($VP_{actual}$) is monitored in step (c), said transmix material being different from said batch of gasoline, said butane, and said previous batch of material.

13. The method of claim 6 further comprising the steps, prior to step (c), of:

(e) determining whether said batch of gasoline is known to have a preblending vapor pressure which is less than said target vapor pressure ($VP_{target}$) and (f) when it is determined that said preblending vapor pressure is less than said target vapor pressure ($VP_{target}$), adding said butane to said batch of gasoline flowing through said line during at least a portion of said analysis delay interval.

14. The method of claim 13 wherein said butane is added to said batch of gasoline in step (f) at a default rate of not more than 0.25% by volume of a rate of said batch of gasoline flowing through said line.

15. A method of in-line addition of a blending stock to a volume ($V_{FS}$) of a fuel stock flowing through a line to produce a blended product which flows to a tank, wherein said blended product has a blended product target vapor pressure (BTVP), said tank has a volume ($V_H$) of a tank heel material therein prior to receiving said blended product, said tank heel has an actual beginning tank heel vapor pressure ($VP_{THActual}$) which is less than a desired vapor pressure ($VP_{THDesired}$) for said tank heel material, said line has an addition point for adding said blending stock, and said method comprises the steps of:

(a) determining an incremental increase (ΔVP) in said blended product target vapor pressure (BTVP) for said volume ($V_{FS}$) of said fuel stock wherein $$\Delta VP=(V_H/V_{FS})\times(VP_{THDesired}-VP_{THActual});$$

(b) determining a modified blended product target vapor pressure (MBTVP) for said volume ($V_{FS}$) of said fuel stock wherein $$MBTVP=BTVP+\Delta VP;$$

(c) automatically monitoring, at a point downstream of said addition point, an actual vapor pressure ($VP_{Actual}$) of said fuel stock or said blended product using an automated vapor pressure analyzer; and (d) adding at said addition point to said volume ($V_{FS}$) of said fuel stock flowing through said line said blending stock at a blending stock addition rate which is automatically controlled by comparing said actual vapor pressure ($VP_{Actual}$) to said modified blended product target vapor pressure (MBTVP) for said volume ($V_{FS}$) of said fuel stock.

16. The method of claim 15 wherein said volume ($V_{FS}$) of said fuel stock is an entire batch of said fuel stock delivered through said line.

17. The method of claim 15 wherein said volume ($V_{FS}$) of said fuel stock is a portion of a batch of said fuel stock delivered through said line.

18. The method of claim 15 wherein said fuel stock is gasoline and said blending stock is butane.

19. The method of claim 15 wherein:

said volume ($V_{FS}$) of said fuel stock flows through said line in step (d) at a fuel stock flow rate and, when said actual vapor pressure ($VP_{Actual}$) is less than said modified blended product target vapor pressure (MBTVP), said blending stock addition rate is controlled in step (d) in a manner to effectively implement automatic changes (Δ Blending %) to a current value of a blending percentage ratio (Blending % Ratio) to produce a new value of said blending percentage ratio (Blending % Ratio) such that:

said Blending % Ratio=[(said blending stock addition rate)/(said fuel stock flow rate)]×100%, said Δ Blending % is a value directly proportional to ($MBTVP-VP_{Actual}$), and said new value of said Blending % Ratio=said current value of said Blending % Ratio+said Δ Blending %.

20. The method of claim 19 wherein said fuel stock is gasoline and said blending stock is butane.

21. The method of claim 20 wherein said Δ Blending %=(MBTVP−$VP_{Actual}$)×(2/100).

22. A method of in-line addition of a blending stock to a fuel stock to produce a blended product without exceeding an allowable volatility value for said blended product, said method comprising the steps of:

(a) determining an arrival of said fuel stock flowing through a line, said line having an addition point for adding said blending stock;

(b) when said arrival of said fuel stock has been determined in accordance with step (a), initiating an analysis delay interval;

(c) when said analysis delay interval ends, automatically monitoring, at a point downstream of said addition point, an actual volatility value of said fuel stock or said blended product flowing through said line using an automated volatility analyzer, wherein said automated volatility analyzer is not operated during said analysis delay interval to monitor said actual volatility value;

(d) adding at said addition point to said fuel stock flowing through said line said blending stock at a blending stock addition rate which is automatically controlled by comparing said actual volatility value to a target volatility value for said blended product, wherein said target volatility value for said blended product is a target vapor pressure ($VP_{target}$) and said actual volatility value is an actual vapor pressure ($VP_{actual}$), said fuel stock flows through said line in step (d) at a fuel stock flow rate, and, when said actual vapor pressure ($VP_{actual}$) is less than said target vapor pressure ($VP_{target}$), said blending stock addition rate is controlled in step (d) in a manner to effectively implement automatic changes (Δ Blending %) to a current value of a blending percentage ratio ((Blending % Ratio) to produce a new value of said blending percentage ratio (Blending % Ratio) such that:

said Blending % Ratio=[(said blending stock addition rate)/(said fuel stock flow rate)]×100%, said Δ Blending %=($VP_{target}$−$VP_{actual}$)×(2/100), and said new value of said Blending % Ratio=said current value of said Blending % Ratio+said Δ Blending %.

23. A method of in-line addition of a blending stock to a fuel stock flowing through a line to produce a blended product without exceeding an allowable volatility value for said blended product, said blending stock being added to said line at an addition point and said method comprising the steps of:

(a) automatically monitoring, at a point downstream of said addition point, an actual volatility value of said fuel stock or said blended product flowing through said line using an automated volatility analyzer and (b) adding at said addition point to said fuel stock flowing through said line said blending stock at a blending stock addition rate which is automatically controlled by comparing said actual volatility value to a target volatility value for said blended product, wherein said target volatility value for said blended product is a target vapor pressure ($VP_{target}$) and said actual volatility value is an actual vapor pressure ($VP_{actual}$);

said fuel stock flows through said line in step (b) at a fuel stock flow rate; and when said actual vapor pressure ($VP_{actual}$) is less than said target vapor pressure ($VP_{target}$), said blending stock addition rate is controlled in step (b) by implementing automatic changes (Δ Blending %) to a current value of a blending percentage ratio (Blending % Ratio) to produce a new value of said blending percentage ratio (Blending % Ratio) such that:

said Blending % Ratio=[(said blending stock addition rate)/(said fuel stock flow rate)]×100%, said Δ Blending %=($VP_{target}$−$VP_{target}$)×$C$, C is 2/100, and said new value of said Blending % Ratio=said current value of said Blending % Ratio+said Δ Blending %.

24. A method of in-line addition of butane to gasoline to produce a blended product without exceeding an allowable vapor pressure for said blended product, wherein said gasoline flows through a line having an addition point for adding said butane and said method comprises the steps of:

(a) determining an arrival of said gasoline;

(b) when said arrival of said gasoline has been determined in accordance with step (a), initiating an analysis delay interval;

(c) when said analysis delay interval ends, automatically monitoring, at a point downstream of said addition point, an actual vapor pressure ($VP_{actual}$) of said gasoline or said blended product using an automated vapor pressure analyzer, wherein said automated vapor pressure analyzer is not operated during said analysis delay interval to monitor said actual vapor pressure ($VP_{actual}$); and (d) adding at said addition point, to said gasoline flowing through said line, said butane at a butane addition rate which is automatically controlled by comparing said actual vapor pressure ($VP_{actual}$) to a target vapor pressure ($VP_{target}$) for said blended product, wherein said gasoline flows through said line in step (d) at a gasoline flow rate and, when said actual vapor pressure ($VP_{actual}$) is less than said target vapor pressure ($VP_{target}$), said butane addition rate is controlled in step (d) in a manner to effectively implement automatic changes (Δ Blending %) to a current value of a blending percentage ratio (Blending % Ratio) to produce a new value of said blending percentage ratio (Blending % Ratio) such that:

said Blending % Ratio=[(said butane addition rate)/(said gasoline flow rate)]×100%, said Δ Blending %=($VP_{target}$−$VP_{actual}$)×2/100, and said new value of said Blending % Ratio=said current value of said Blending % Ratio+said Δ Blending %.

25. A method of in-line addition of butane to gasoline to produce a blended product without exceeding an allowable vapor pressure for said blended product, wherein said gasoline flows through a line having an addition point for adding said butane and said method comprises the steps of:

(a) automatically monitoring, at a point downstream of said addition point, an actual vapor pressure ($VP_{actual}$) of said gasoline or said blended product using an automated vapor pressure analyzer and (b) adding at said addition point, to said gasoline flowing through said line, said butane at a butane addition rate which is automatically controlled by comparing said actual vapor pressure ($VP_{actual}$) to a target vapor pressure ($VP_{target}$) for said blended product, wherein said gasoline flows through said line in step (b) at a gasoline flow rate and when said actual vapor pressure ($VP_{actual}$) is less than said target vapor pressure ($VP_{target}$), said butane addition rate is controlled in step (b) to implement automatic changes (Δ Blending %) to a current value of a blending percentage ratio (Blending % Ratio) to produce a new value of said blending percentage ratio (Blending % Ratio) such that:

said Blending % Ratio=[(said butane addition rate)/(said gasoline flow rate)]×100%, said Δ Blending %=$C\times(VP_{target}-VP_{actual})$ C is 2/100, and said new value of said Blending % Ratio=said current value of said Blending % Ratio+said Δ Blending %.

26. A method of in-line addition of butane to gasoline to produce a blended product without exceeding an allowable Reid Vapor Pressure (RVP) for said blended product, said blended product having a target RVP ($RVP_{target}$) and said method comprising the steps of:

(a) delivering said gasoline through a line having an addition point for addition of said butane, said gasoline flowing through said line at a gasoline flow rate;

(b) automatically monitoring, at a point downstream of said addition point, an actual RVP ($RVP_{actual}$) of said gasoline or said blended product flowing through said line using an automated RVP analyzer; and (c) adding said butane to said gasoline at said addition point at a butane addition rate which is automatically controlled, wherein, when said actual RVP ($RVP_{actual}$) is less than said target RVP ($RVP_{target}$), said butane addition rate is controlled in step (c) in a manner to effectively implement automatic changes (Δ Blending %) to a current value of a blending percentage ratio (Blending % Ratio) to produce a new value of said blending percentage ratio (Blending % Ratio) such that:

said Blending % Ratio=[(said butane addition rate)/(said gasoline flow rate)]×100%, said Δ Blending %=$(RVP_{target}-RVP_{actual})\times(2/100)$, and said new value of said Blending % Ratio=said current value of said Blending % Ratio+said Δ Blending %.

* * * * *